US010041323B2

(12) United States Patent
Vanderford

(10) Patent No.: US 10,041,323 B2
(45) Date of Patent: Aug. 7, 2018

(54) ADJUSTABLE ACTUATOR

(71) Applicant: Cameron International Corporation, Houston, TX (US)

(72) Inventor: Delbert Edwin Vanderford, Cypress, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 85 days.

(21) Appl. No.: 14/586,595

(22) Filed: Dec. 30, 2014

(65) Prior Publication Data

US 2016/0186528 A1 Jun. 30, 2016

(51) Int. Cl.
*E21B 33/03* (2006.01)

(52) U.S. Cl.
CPC ..... *E21B 33/03* (2013.01)

(58) Field of Classification Search
CPC ..... E21B 33/03; E21B 33/04
See application file for complete search history.

(56) References Cited

U.S. PATENT DOCUMENTS 1,750,143 A * 3/1930 Wickersham ..... E21B 33/05 166/70
1,866,726 A * 7/1932 Santiago ..... E21B 33/04 166/70
3,119,449 A * 1/1964 Price ..... E21B 34/02 137/382
3,166,124 A * 1/1965 Johnson ..... E21B 33/064 137/454.2
3,208,349 A * 9/1965 Burnett ..... E21B 47/042 181/124
3,228,472 A * 1/1966 Rhoads, Jr. ..... E21B 41/02 166/64
4,190,270 A * 2/1980 Vanderford ..... E21B 33/04 285/123.9
4,718,679 A * 1/1988 Vyvial ..... F16J 15/28 277/328
4,770,250 A 9/1988 Bridges et al.
5,158,326 A * 10/1992 Anderson ..... E21B 33/0422 285/123.9
5,209,521 A 5/1993 Osborne
7,380,607 B2 6/2008 Thomas
2004/0188087 A1 9/2004 DeBerry
(Continued)

FOREIGN PATENT DOCUMENTS

WO 03012251 2/2003

OTHER PUBLICATIONS

International Search Report and Written Opinion of PCT Application No. PCT/US2015/064748 dated Jun. 13, 2016: pp. 1-9.

*Primary Examiner* — Shane Bomar
(74) *Attorney, Agent, or Firm* — Chamberlain Hrdlicka

(57) ABSTRACT

An apparatus to define a shoulder within equipment includes a pin assembly and an actuator. The pin assembly includes a pin assembly housing with a passage formed therethrough, a pin movably positionable, at least partially, within the passage of the pin assembly housing, an outer stop to limit outward movement of the pin within the passage of the pin assembly housing, and an inner stop to limit inward movement of the pin within the passage of the pin assembly housing. The actuator is operably coupled to the pin assembly such that the actuator is capable of moving the pin within the pin assembly housing of the pin assembly.

19 Claims, 2 Drawing Sheets

(56) References Cited

U.S. PATENT DOCUMENTS

2011/0203810 A1* 8/2011 Nguyen ..... E21B 33/03
166/387
2014/0345849 A1 11/2014 Nguyen

* cited by examiner

ADJUSTABLE ACTUATOR

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead system through which the resource is extracted. These wellhead systems may include a wide variety of components, such as a high pressure wellhead housing and various casings, hangers, valves, fluid conduits, and the like, that control drilling and/or extraction operations.

As such, when drilling a well for oil or gas, typically a high pressure wellhead housing will be mounted at the outer end of the well that may be used to support one or more tubular strings extending into the well. In one example, a string of casing may be run into and installed within the well. A casing hanger is then located at the outer end of the string of casing, in which the casing hanger lands upon a load shoulder in the high pressure wellhead housing. The load shoulder can be machined into the bore of the high pressure wellhead housing. Alternatively, the load shoulder can be a separate high strength ring that is installed into a groove in the high pressure wellhead housing, such as when the high pressure wellhead housing is initially manufactured. In both cases, the inner diameter of the bore of the high pressure wellhead housing decreases in a downward direction, with the smaller inner diameter located below the load shoulder.

The stepped diameter bore has a disadvantage. Drilling tools can be no larger than the minimum inner diameter located below the load shoulder. However, it is often desired to utilize a drill bit or tool that is larger than minimum inner diameter. For example, in a wellhead system that is used in containment of offshore shallow flow zones, it is desired to run a casing, which is typically has an 18 inch (0.456 m) diameter, through a subsea high pressure housing having a minimum bore that is typically 18.63 inches (0.473 m). The nominal seat of the high pressure wellhead housing (e.g., the insert load shoulder) must be removed or left off of the assembly prior to running a high pressure wellhead housing and then reinstalled subsequent to the installation of the casing. Accordingly, there is a demand to simplify the process of running tools into or through a high pressure wellhead housing that includes a load shoulder.

BRIEF DESCRIPTION OF THE DRAWINGS

For a detailed description of embodiments of the subject disclosure, reference will now be made to the accompanying drawings in which.

DETAILED DESCRIPTION

Figure 1:
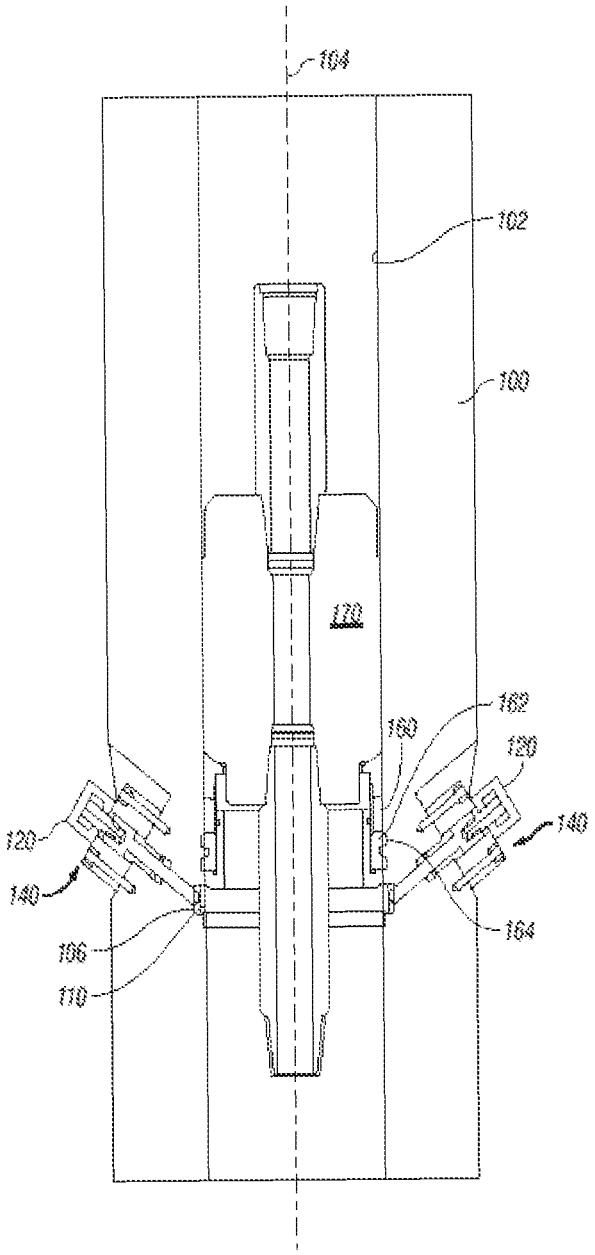
FIG. 1 shows a cross-sectional view of a system or apparatus used to define a shoulder within equipment in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. The embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be an illustration of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Referring now to FIG. 1, a cross-sectional view of a system and/or an apparatus used to define a shoulder within equipment, such as oil and gas equipment, in accordance with one or more embodiments of the present disclosure is shown. In particular, FIG. 1 shows a cross-sectional view of a spool or housing 100 that may include or use an activation ring 110, one or more actuators 120, and one or more pin assemblies 140. The housing 100 may be a high pressure wellhead housing and/or any other type of equipment used to define, form, or otherwise include a shoulder within the housing 100. For example, the housing 100 may be a high pressure wellhead housing, and/or may be any other type of oil and gas equipment, in which the housing 100 may be used within surface and/or subsea applications and may be used within drilling and/or production applications. The housing 100 may include a bore 102 formed through and about an axis 104 of the housing 100.

A recess 106 may be formed within the bore 102 and/or extend into an inner wall of the housing 100. The activation ring 110 may then be positioned within the recess 106 such that the activation ring 110 is movable within and with respect to the recess 106. In particular, the activation ring 110 may be movable within and respect to the recess 106 for the activation ring 110 to extend, at least partially, into the bore 102 and towards the axis 104 of the housing 100 to define a shoulder within the housing 100. The shoulder may be used for one or more components to land upon the shoulder within the housing 100. As such, the activation ring 110 may be movable between a retracted position and an extended position with respect to the recess 106 and/or the axis 104 of the housing 100. In the retracted position, the activation ring 110 may be retracted (e.g., fully retracted) into the recess 106 such that the activation ring 110 to provide no restriction to the internal diameter of the bore 102 of the housing 100. In the extended position, the activation ring 110 extends, at least partially, from the recess 106 and into the bore 102 such that the activation ring 110 may define the shoulder within the bore 102 of the housing 100. Accordingly, an activation ring in accordance with the present disclosure may be a split ring, a c-ring, and/or any other type of ring or component that may be expandable and retractable to define a shoulder within a housing.

As mentioned above, one or more actuators 120 may be included, such as to move the activation ring 110 within the recess 106 and/or towards and away from the axis 104. This may enable the activation ring 110 to be controlled by and actuated by the one or more actuators 120. For example, as shown, one or more pin assemblies 140 may be included and connected to the housing 100, with an actuator 120 operably coupled to each pin assembly 140 such that the actuator 120 moves the activation ring 110 using the pin assembly 140. As such, each pin assembly 140 included may have a corresponding actuator 120 operably coupled to the pin assembly 140 to operate the pin assembly 140 and move the activation ring 110 using the pin assembly 140. In an embodiment in which more than one pin assembly 140 is included, the pin assemblies 140 may be equally spaced from each other, such as equally spaced about the axis 104. For example, in an embodiment in which four pin assemblies 140 are included with the housing 100, each of the pin assemblies 140 may be positioned about 90 degrees away from each other with respect to the axis 104 of the housing 100. This may enable an equal distribution of force upon the activation ring 110 by the actuators 120.

The activation ring 110 may be extendable (e.g., inward) into the bore 102 of the housing 100 such as to form and define a shoulder within the housing 100, in which one or more components may then land upon the shoulder within the housing 100. Accordingly, as shown in FIG. 1, a load shoulder sleeve 160 may be introduced into the housing 100 and landed upon the activation ring 110 when extended into and defining a shoulder within the bore 102 of the housing 100. Upon landing, the load shoulder sleeve 160 may then have one or more dogs 162 that expand into and engage one or more corresponding recesses 164 formed within the bore 102 of the housing 100. In such an embodiment, the load shoulder sleeve 160 may have a higher strength capacity than that of the activation ring 110, in which one or more components may then land upon the load shoulder sleeve 160.

For example, as shown in FIG. 1, an expandable packing tool 170 and/or blowout preventer tester may land upon the load shoulder sleeve 160. The housing 100 may therefore be installed below a blowout preventer or a blowout preventer stack, such as when testing one or more blowout preventers. Further, those having ordinary skill in the art will appreciate that a load shoulder sleeve 160 may not be used or necessary, thereby landing the expandable packing tool 170 directly upon the activation ring 110. Additionally or alternatively, other components, such as a tubing hanger, may be landable upon the shoulder when the activation ring 110 is extended into the bore 102 of the housing 100.

Figure 2:
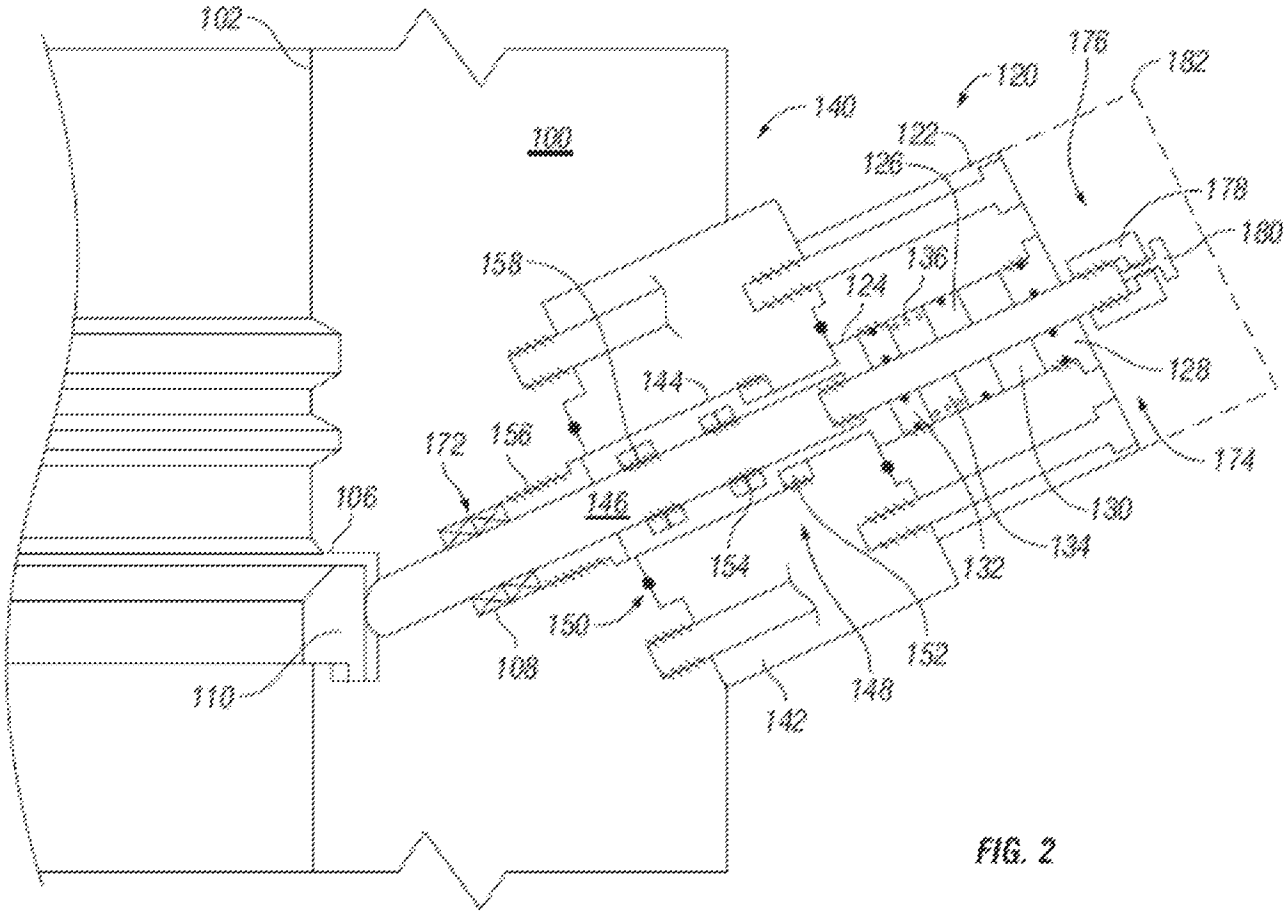
FIG. 2 shows a detailed cross-sectional view of a system or apparatus used to define a shoulder within equipment in accordance with one or more embodiments of the present disclosure.

Referring now to FIG. 2, a detailed cross-sectional view of an apparatus used to define a shoulder within equipment, such as oil and gas equipment, in accordance with one or more embodiments of the present disclosure is shown. In particular, FIG. 2 may provide a more detailed view of the actuator 120 and the pin assembly 140 in use with the housing 100. An actuator in accordance with the present disclosure may be a hydraulic actuator, a pneumatic actuator, an electrical actuator, a mechanical actuator, and/or any other type of actuator known in the art, or any combination of these. In this embodiment, the actuator 120 may include a housing 122 with a passage 124 formed therethrough. A piston 126 may then be movably positioned, at least partially, within the passage 124 such that the piston 126 forms multiple chambers within the passage 124 of the actuator 120. An outer plug 128 may be positioned within the passage 124 on one side of the piston 126, thereby defining an outer chamber 130 within the passage 124 between the piston 126 and the outer plug 128. Further, an inner plug 132 may be positioned within the passage 124 on another side of the piston 126, thereby defining an inner chamber 134 within the passage 124 between the piston 126 and the inner plug 132.

The pin assembly 140 may include a housing 142 with a passage 144 formed through the housing 142. The housing 142 may be connected to the housing 100, such as through the use of one or more attachments mechanisms, such as a nut, bolt, screw, and/or any other attachment mechanism known in the art. A passage 108 may be formed within the housing 100 corresponding to each pin assembly 140, in which the passage 108 may extend from an exterior surface to the recess 106 of the housing 100 to enable the pin assembly 140 to engage the activation ring 110 in the recess 106. As such, the passage 144 of the housing 142 may be in alignment with the passage 108. The pin assembly 140 may further include a pin 146, in which the pin 146 may be movably positioned, at least partially, within the passage 144 of the housing 142. The pin 146 may also extend into and through the passage 108 of the housing 100 such that the pin 146 engages the activation ring 110. For example, the actuator 120 may be operably coupled to the pin 146 such that the actuator 120 moves the activation ring 110 within and with respect to the recess 106 using the pin 146. In particular, in this embodiment, the piston 126 may be coupled, such as connected (e.g., threadedly connected) to the pin 146 of the pin assembly 140. Additionally or alternatively, the activation ring 110 may be connected to the pin 146 of the pin assembly 140, such as through a button and slot engagement, in which the pin 146 may move the activation ring 110 as the pin 146 moves between the extended position and the retracted position.

Referring still to FIG. 2, the pin assembly 140 may include one or more stops, such as to limit or prevent movement of the pin 146 within the passage 144. In this embodiment, the pin assembly 140 may include an outer stop 148, such as to limit the outward movement of the pin 146 within the passage 144 of the housing 142, and an inner stop 150, such as to limit the inward movement of the pin 146 within the passage 144 of the housing 142.

In one or more embodiments, the outer stop 148 and/or the inner stop 150 may be adjustable such that the limit of the movement of the pin 146 within the passage 144 of the housing 144 is adjustable. The outer stop 148 may include an outer stop seat 152 positionable within, such as threadedly engaged with, the passage 144 of the housing 142. Further, the outer stop 148 may include an outer stop shoulder 154 positionable on, such as threadedly engaged with, the pin 146. For example, in one or more embodiments, the outer stop shoulder 154 may include one or more rings or nuts, such as by including an engagement nut to engage the outer stop seat 152 and a locking nut to lock the engagement nut in position with respect to the pin 146. Engagement of the outer stop seat 152 with the outer stop shoulder 154 may prevent outward movement of the pin 146 within the passage 144 of the housing 142. As such, the outer stop 148 may be adjustable, such as by adjusting the position of the outer stop seat 152 and/or the outer stop shoulder 154 with respect to each other, thereby adjusting the point of engagement therebetween and the limit of outward movement of the pin 146 within the passage 144 of the housing 142.

Further, the inner stop 150 may include an inner stop seat 156 positionable within, such as threadedly engaged with, the passage 108 of the housing 100. The outer stop 148 may also include an inner stop shoulder 158 positionable on, such as threadedly engaged with, the pin 146. For example, as with the outer stop shoulder 154, the inner stop shoulder 158 may include one or more rings or nuts, such as by including an engagement nut to engage the inner stop seat 156 and a locking nut to lock the engagement nut in position with respect to the pin 146. Engagement of the outer stop seat 152 with the outer stop shoulder 154 may prevent outward movement of the pin 146 within the passage 144 of the housing 142. As such, the inner stop 150 may be adjustable, such as by adjusting the position of the inner stop seat 156 and/or the inner stop shoulder 158 with respect to each other, thereby adjusting the point of engagement therebetween and the limit of inward movement of the pin 146 within the passage 144 of the housing 142. Those having ordinary skill in the art may also appreciate that the pin 146 may be formed as a monolithic or integral structure with the inner stop shoulder 158 and/or the outer stop shoulder 154, rather than having the inner stop shoulder 158 and/or the outer stop shoulder 154 threadedly engaged with the pin 146.

In this embodiment, to be able to minimize an outer diameter for the housing 100 with the pin assembly 140 and actuator 120 connected thereto, the actuator 120 and/or the pin assembly 140 may be positioned at an angle with respect to the housing 100. For example, the pin 146 of the pin assembly 140 may extend at an angle with respect to a direction that is perpendicular with respect to the axis 104 of the housing 100. In such an embodiment, the pin 146 may then slidingly engage the activation ring 110 such that the pin 146 may slide against a back surface of the activation ring 110 when moving the activation ring 110.

One or more seals or seal assemblies may be used to seal within or between the actuator, the pin assembly, and/or the housing. For example, with reference to FIG. 2, a seal assembly 172, such as a seal carrier, stem packer, and/or any other type of seal or seal assembly, may be positioned between the pin assembly 140 and the housing 100. In particular, a seal assembly 172 that includes or carries one or more seals, may be positioned, at least partially, within the passage 108 of the housing 100. The pin 146 of the pin assembly 140 may then extend through the seal assembly 172 such that the seal assembly 172 is able to seal between the pin 146 and the passage 108 of the housing 100. As such, the seal assembly 172 may threadedly engage or connect with the passage 108 of the housing 100 and/or be packed by the inner stop seat 156.

Further, with reference to FIG. 2, one or more of the following seals may be used in addition or in alternative to the seal assembly 172. A seal may be positioned between the housing 100 and the housing 142 of the pin assembly 140 to seal therebetween. A seal may be positioned between the housing 142 of the pin assembly 140 and the housing 122 of the actuator 120 to seal therebetween. A seal may be positioned between the piston 126 and the passage 124 of the actuator 120 to seal therebetween. A seal may be positioned between the outer plug 128 and the piston 126 to seal therebetween. A seal may be positioned between the outer plug 128 and the passage 124 of the actuator 120 to seal therebetween. A seal may be positioned between the inner plug 132 and the piston 126 to seal therebetween. Further, a seal may be positioned between the inner plug 132 and the passage 124 of the actuator 120 to seal therebetween.

As discussed above, the activation ring 110 may be movable between a retracted position and an extended position with respect to the recess 106 and/or the axis 104 of the housing 100. As such, the pin 146 of the pin assembly 140 and/or the piston 126 of the actuator 120 may also be movable between a retracted position and an extended position, such as along with the activation ring 110. To move the piston 126, the pin 146, and/or the activation ring 110 to the extended position, pressure may be introduced into the outer chamber 130 of the actuator 120 to force and move the piston 126 inward. This correspondingly may move the pin 146 of the pin assembly 140 coupled to the piston 126 inward towards the extended position, and thereby moving the activation ring 110 engaged by and/or coupled to the pin 146 towards the extended position. The inner stop 150 may then limit the inward movement of the pin 146 within the passage 144 of the housing 142 to define the extended position of the piston 126, the pin 146, and/or the activation ring 110.

To move the piston 126, the pin 146, and/or the activation ring 110 to the retracted position, pressure may be introduced into the inner chamber 134 of the actuator 120 to force and move the piston 126 outward. This correspondingly may move the pin 146 of the pin assembly 140 coupled to the piston 126 outward towards the retracted position, and thereby moving the activation ring 110 towards the retracted position. The outer stop 148 may then limit the outward movement of the pin 146 within the passage 144 of the housing 142 to define the retracted position of the piston 126, the pin 146, and/or the activation ring 110. In one or more embodiments, to enable or facilitate movement of the piston 146 within the passage 144 of the housing 142, the passage 144 may be vented, such as to an area of lower pressure. Further, those having ordinary skill in the art will appreciate that, though while pressure is discuss above as introduced into the outer chamber 130 and/or the inner chamber 134, the opposite may be used (e.g., suction) with the respective chambers to move the piston 126. Further, the piston 126 can be controlled (i.e., moved inward and/or outward) through only one chamber and/or one port if so desired.

As shown in FIG. 2, a biasing mechanism 136 (e.g., a spring) may be used, such as to bias the piston 126 and/or the pin 146 away from the extended position and towards the retracted position. As such, in this embodiment, the biasing mechanism may be positioned within the inner chamber 134 to bias the piston 126 towards the retracted position. Such an arrangement may enable the piston 126, the pin 146, and/or the activation ring 110 to move towards the retracted position, such as for these components to have a fail-safe outward or retracted position.

Referring still to FIG. 2, an indicator 174 may be used to indicate a position of the piston 126, the pin 146, and/or the activation ring 110. For example, an indicator 174 may include indications or markings on an end of the piston 126 in this embodiment and may be exterior to the housing 122 of the actuator 120 to indicate a position of the piston 126, and therefore may also indicate a position of the pin 146 coupled to the piston 126 and the activation ring 110 engaged by the pin 146.

Further, a lockout device 176 may be used to lockout the position of the pin 146 and/or prevent movement of the pin 146 within the passage 144 of the housing 142. In an embodiment in which the pin 146 should not be moved into the extended position (e.g., during installation or before expected use), the lockout device 176 may be used to prevent any undesired movement of the pin 146. In this embodiment, the lockout device 176 may be coupled to the piston 126 to prevent movement of the piston 126 and the pin 146 coupled thereto. The lockout device 176 may then be removed before use of the actuator 120 and/or the pin assembly 140. The lockout device 176 may further be adjustable, such as to adjust and/or limit the movement of the piston 126 and/or the pin 146, as desired. For example, in this embodiment, the lockout device 176 may include a cap 178 that may threadedly engage the piston 126, and a fastener 180 that may threadedly engage the cap 178 and abut the piston 126. As such, the cap 178 and the fastener 180 may be adjusted, as desired, to set a limit for the movement of the piston 126 and the pin 146.

In one or more embodiments, a removable shroud 182 may be used to protect one or more components of the actuator 120 and/or pin assembly 140. For example, in this embodiment, the removable shroud 182 may be positioned over an end of the actuator 120 to protect the indicator 174 and/or the lockout device 176. However, the removable shroud 182 may additionally or alternatively be used to cover the actuator 120, such as by removably attaching to a base of the housing 122 of the actuator 120 and/or a top of the housing 142 of the pin assembly 140, and/or may be used to cover the pin assembly 140, such as by removably attaching to a base of the housing 142 of the pin assembly 140 and/or a surface of the housing 100.

Those having ordinary skill in the art will appreciate that, though an activation ring is shown in use in FIG. 1 to define a shoulder in the housing or other equipment, the present disclosure is not so limited. For example, in one or more other embodiments, an activation ring may not be present, in which one or more pins of pin assemblies may be used to define a shoulder within a housing or equipment. In such an embodiment, the pin 146 may then not engage an activation ring 110, and instead extend into the bore 102 of the housing 100, in which a device, component, or equipment may then land upon the pin 146 and use the pin 146 as a shoulder.

Although the present invention has been described with respect to specific details, it is not intended that such details should be regarded as limitations on the scope of the invention, except to the extent that they are included in the accompanying claims.

What is claimed is:

1. An apparatus, comprising:

a pin assembly, comprising:

a pin assembly housing comprising a passage formed therethrough;

a pin movably positionable, at least partially, within the passage of the pin assembly housing;

an outer stop to limit outward movement of the pin within the passage of the pin assembly housing; and an inner stop to limit inward movement of the pin within the passage of the pin assembly housing;

wherein at least one of the outer stop and the inner stop of the pin assembly are adjustable such that the limit of movement of the pin within the passage of the pin assembly housing is adjustable; and an actuator operably coupled to the pin assembly such that the actuator is capable of moving the pin within the pin assembly housing of the pin assembly, the actuator comprising a lockout device to prevent movement of the pin within the passage of the pin assembly housing.

2. The apparatus of claim 1, further comprising:

an activation ring engageable by the pin assembly with the actuator capable of moving the activation ring using the pin assembly.

3. The apparatus of claim 1, wherein the inner stop comprises an inner stop seat and an inner stop shoulder positionable on the pin such that engagement of the inner stop seat with the inner stop shoulder prevents inward movement of the pin within the passage of the pin assembly housing.

4. The apparatus of claim 1, wherein the outer stop comprises an outer stop seat positionable within the passage of the pin assembly housing and an outer stop shoulder positionable on the pin such that engagement of the outer stop seat with the outer stop shoulder prevents outward movement of the pin within the passage of the pin assembly housing.

5. The apparatus of claim 4, wherein the outer stop shoulder is engaged with the pin, wherein the outer stop shoulder comprises an engagement nut and a locking nut.

6. The apparatus of claim 1, wherein both the outer stop and the inner stop of the pin assembly are adjustable such that the limit of movement of the pin within the passage of the pin assembly housing is adjustable.

7. The apparatus of claim 1, wherein the actuator comprises:

an actuator housing comprising a passage formed therethrough; and a piston movably positionable, at least partially, within the passage of the actuator housing, thereby defining an outer chamber and an inner chamber within the passage of the actuator housing;

wherein the piston is coupled to the pin.

8. The apparatus of claim 7, wherein the actuator further comprises a biasing mechanism positioned within the inner chamber to bias the pin towards a retracted position.

9. The apparatus of claim 7, wherein the actuator further comprises an indicator exterior to the actuator housing of the actuator to indicate a position of the pin within the passage of the pin assembly housing.

10. The apparatus of claim 7, wherein the lockout device is coupleable to the piston to prevent movement of the pin within the passage of the pin assembly housing.

11. An apparatus, comprising:

a high pressure wellhead housing comprising an innermost bore formed therethrough and an inner wall comprising a recess formed within the innermost bore; and a pin assembly, comprising:

a pin assembly housing comprising a passage formed therethrough;

a pin movably positionable, at least partially, within the passage of the pin assembly housing;

an outer stop to limit outward movement of the pin within the passage of the pin assembly housing; and an inner stop to limit inward movement of the pin within the passage of the pin assembly housing;

an actuator operably coupled to the pin assembly such that the actuator is capable of moving the pin assembly; and an activation ring positionable within the recess and movable to extend, at least partially, out of the recess and into the innermost bore of the high pressure wellhead housing to define a shoulder within the innermost bore of the high pressure wellhead housing.

12. The apparatus of claim 11, wherein the activation ring is movable between a retracted position and an extended position with respect to the recess such that, in the retracted position, the activation ring is fully retracted within the recess and, in the extended position, the activation ring extends, at least partially, into the innermost bore of the high pressure wellhead housing to define the shoulder within the high pressure wellhead housing.

13. The apparatus of claim 11, wherein at least one of the outer stop and the inner stop of the pin assembly are adjustable such that the limit of movement of the pin within the passage of the pin assembly housing is adjustable.

14. The apparatus of claim 11, wherein the inner stop comprises an inner stop seat positionable within a passage of the high pressure wellhead housing and an inner stop shoulder positionable on the pin such that engagement of the inner stop seat with the inner stop shoulder prevents inward movement of the pin within the passage of the pin assembly housing.

15. The apparatus of claim 11, wherein the outer stop comprises an outer stop seat positionable within the passage of the pin assembly housing and an outer stop shoulder positionable on the pin such that engagement of the outer stop seat with the outer stop shoulder prevents outward movement of the pin within the passage of the pin assembly housing.

16. The apparatus of claim 11, wherein the actuator comprises:

an actuator housing comprising a passage formed therethrough; and a piston movably positionable, at least partially, within the passage of the actuator housing, thereby defining an outer chamber and an inner chamber within the passage of the actuator housing;

wherein the piston is coupled to the pin.

17. The apparatus of claim 16, wherein the actuator further comprises a biasing mechanism positioned within the inner chamber to bias the pin towards a retracted position.

18. The apparatus of claim 16, wherein the actuator further comprises an indicator exterior to the actuator housing of the actuator to indicate a position of the pin within the passage of the pin assembly housing.

19. The apparatus of claim 16, wherein the actuator further comprises a lockout device coupleable to the piston to prevent movement of the pin within the passage of the pin assembly housing.

* * * * *